United States Patent [19]

Fulmer et al.

[11] 4,450,216

[45] May 22, 1984

[54] METHOD FOR IMPROVING THE SENSITOMETRIC RESPONSE OF A PERSISTENTLY CONDUCTIVE PHOTORECEPTOR

[75] Inventors: George G. Fulmer, Victor; John R. Lawson, Pittsford, both of N.Y.

[73] Assignee: Eastman Kodak Company, Rochester, N.Y.

[21] Appl. No.: 443,786

[22] Filed: Nov. 22, 1982

[51] Int. Cl.[3] ..... G03G 13/052; G03G 13/22

[52] U.S. Cl. ..... 430/31; 430/902

[58] Field of Search ..... 430/31, 902

[56] References Cited

U.S. PATENT DOCUMENTS 3,113,022 12/1963 Cassiers et al. ..... 430/31 X 4,038,544 7/1977 Shenoy ..... 250/315 R

FOREIGN PATENT DOCUMENTS 982285 2/1965 United Kingdom ..... 430/902

OTHER PUBLICATIONS

Cassiers, "Memory Effects in Electrophotography", Jour. Photo. Sci., vol. 10, 1962, pp. 57–65.

*Primary Examiner*—Roland E. Martin, Jr.

*Attorney, Agent, or Firm*—Torger N. Dahl

[57] ABSTRACT

A method for improving the sensitometric response of a persistently conductive photoreceptor is disclosed. This method involves charging and exposing the photoreceptor to form a latent electrostatic image and thereafter, within the period of persistence, recharging the photoreceptor to the same polarity and developing the latent electrostatic image.

12 Claims, No Drawings

METHOD FOR IMPROVING THE SENSITOMETRIC RESPONSE OF A PERSISTENTLY CONDUCTIVE PHOTORECEPTOR

The present invention relates to electrophotography and, more particularly, to a method involving the recharging of a photoreceptor to improve its sensitometric response.

In the process of electrophotography, a photoconductive element, or photoreceptor as it will hereinafter be referred to, is uniformly charged and imagewise-exposed to form a latent electrostatic image. The latent image can then be developed, or transferred to a receiving element and developed, to product a visible image.

The sensitometric response of a photoreceptor can be characterized by several parameters such as the time required to develop the latent image to a visible image (which will be referred to hereinafter as the development rate) and the dynamic exposure range of the latent image. Dynamic exposure range refers to the sensitivity of a photoreceptor to increasing degrees of light exposure and thus whether it is more suited to high-contrast imaging or low-contrast (continuous-tone) imaging. For high-contrast imaging, the amount of photodecay of charge should sharply increase with small increments of exposure. For continuous-tone imaging, the opposite is true: with increasing exposure, the amount of photodecay of charge should increase gradually and thereby produce charge patterns in the photoreceptor which can be developed to intermediate tonal densities, as well as low and high densities.

The method of the present invention improves the sensitometric response of a photoreceptor by the modification of a latent electrostatic image, or charge pattern, on the photoreceptor. In this regard, the prior art in U.S. Pat. No. 4,038,544 issued July 26, 1977, to V. U. Shenoy describes a process of treating a latent electrostatic image with a predevelopment corona so as to eliminate unwanted low-density regions which appear with the developed image. The Shenoy process, however, does not produce a latent image which is capable of a higher development rate or which exhibits an extended dynamic exposure range.

It has now been found that post-exposure, predevelopment charging of a latent electrostatic image on a persistent photoreceptor produces a modified latent electrostatic image of improved sensitometric response if the post-exposure, predevelopment charging step is carried out during the photoreceptor's period of persistence.

The present invention, therefore, comprises a method of improving the sensitometric response of a persistently conductive photoreceptor having a period of persistence comprising:

(a) uniformly charging the surface of said photoreceptor to a given polarity, (b) imagewise-exposing the charged photoreceptor to form a latent electrostatic image thereon and, (c) during the photoreceptor's period of persistence, uniformly recharging the photoreceptor to the same polarity as in (a), thereby producing a developable, modified latent electrostatic image which either can be developed to a visible image at a faster rate or can exhibit an extended dynamic exposure range relative to an otherwise identical process in which said recharging step (a) is omitted.

Persistent conductivity is known in the art as that conductivity exhibited by a photoreceptor for a period of time after an exposure to actinic radiation. This period of conductivity is herein referred to as the period of persistence and can vary among materials from several minutes to days and is sometimes permanent. During the period of persistence, the photoinduced conductivity will sustain a number of develop-transfer-recharge-redevelop sequences in a copy process without additional exposures, and can thus produce multiple copies of an original with a single exposure.

In the method of the present invention, however, persistence is not relied upon to produce multiple copies, but rather to form modified latent electrostatic images of improved sensitometric response. This is accomplished with a post-exposure, predevelopment charging step which changes the previously formed latent electrostatic image on the photoreceptor. Such improved sensitometric response, moreover, is not realized if a nonpersistent photoreceptor is employed, or if post-charging is omitted or takes place after the period of persistence.

For the practice of the invention, a photoreceptor is selected which exhibits persistent conductivity and whose period of persistence is sufficiently long to permit the post-charging step. Preferably, the period of persistence is at least 0.5 hour at ambient temperature (i.e., the temperature to which the photoreceptor is subjected prior to development).

Persistently conductive photoreceptors can be inorganic or organic. Representative inorganic materials include zinc cadmium sulfide and zinc oxide. Useful organic materials include a photoconductive electron donor in combination with an activator to form a charge-transfer complex with the donor, and a protonic acid such as described in U.S. Pat. No. 4,033,769 issued July 5, 1977, to D. J. Williams et al; multiactive photoreceptors composed of an aggregate, photoconductive charge-generating layer and a charge-transport layer, either one or both containing a protonic acid material as described in U.S. Pat. No. 3,997,342 issued Dec. 14, 1976, to D. S. Bailey; the combination of an organic photoconductor, dye sensitizer and an activator selected from the group consisting of organic carboxylic acids, nitrophenols, nitroanilines, and carboxylic anhydrides as described in U.S. Pat. No. 3,512,966 issued May 19, 1970, to M. D. Shuttuck et al. Persistent conductivity and suitable materials are also described by Y. Hayashi, M. Kuroda and A. Inami in *Bull. Chem. Soc.*, Japan, 39, 1660 (1966), and Williams, Pfister and Abkowitz in *Tappi*, 56, 129 (1973).

Preferred persistently conductive photoreceptors exhibiting persistent conductivity comprise polyarylalkane photoconductors in combination with pyrylium dye sensitizers as described in U.S. Pat. Nos. 4,301,226 issued Nov. 17, 1981, to N. G. Rule and L. E. Contois and 3,554,745 issued Jan. 12, 1971, to James VanAllan and in *Research Disclosure*, published by Industrial Opportunities Ltd, Homewell, Havant, Hampshire, PO9 1EF, UK, item 12846, Vol. 128, December, 1974.

The persistently conductive photoreceptor material selected for use is appropriately applied to a conductive support or otherwise electrically grounded for use in the process of the present invention. Techniques for forming elements composed of the selected material are described, for example, in the aforementioned U.S. Pat. No. 4,301,226 to N. G. Rule and L. E. Contois.

In use, the surface of the persistently conductive photoreceptor is uniformly charged to a preselected initial surface potential level, Vo, of either negative or positive polarity. The value of Vo can range from about 100 to 600 volts and is preferably from about 150 to about 450 volts. Measurement of the surface potential is accomplished with an electrometer.

After charging to Vo, the photoreceptor is imagewise illuminated to produce a latent electrostatic image of an original. The amount of such illumination can vary to provide adequate charge contrast between illuminated and nonilluminated regions. Typically, the amount of illumination is selected so as to lower the surface potential of fully illuminated regions on the photoreceptor to ½ Vo or lower so as to encompass the dynamic range of the original.

In known copy processes employing persistently conductive photoreceptors, after formation of a latent electrostatic image, the latent image is developed with toner. In accordance with the present invention, however, an additional uniform charging step interposed between exposure and development we found unexpectedly enhances the sensitometric response of the latent electrostatic image. Such post-exposure, predevelopment charging is of the same polarity as that of the pre-exposure charging and is carried out during the period of the photoreceptor's persistance, as explained above.

By practicing post-exposure charging, the sensitometric response of the photoreceptor is improved in at least two significant respects compared with an identical process which omits the post-exposure charging step. These improvements relate to the development rate of which the charge image is capable and the dynamic exposure range, expressed in log exposure units between the toe and shoulder of a plot of either density or voltage versus log exposure. The toe and shoulder are defined as the point on the curve in the toe or shoulder region where the curve slope is ⅓ the maximum slope of the plot.

The dynamic exposure range of the charge image is greater than that of the image on an identical element not post-exposure charged whenever the charge image is developed in a so-called pos-pos mode. In pos-pos development, charged regions of the image are toner-developed to produce a positive image for a positive original or otherwise detected to determine the image information.

If the charge image is developed by neg-pos development (i.e., a negative image being made from a positive original), its sensitometric response will again be improved with respect to the image produced without post-charging. The improvement, however, differs, depending on when the image is developed within the period of persistence. In neg-pos development, the portion of an element bearing the charge image undergoing development (i.e., the development zone) is electrically biased to cause toner to be attracted to uncharged regions of the image. In accordance with the invention, when neg-pos development is practiced, if development takes place immediately after exposure and post-exposure charging, the charge image is capable of developing at a greater rate compared with the same, or control, process in which post-exposure charging is omitted. To the user, a higher rate of development means decreased time in the development station of a copier and thus faster access to final copies. In this regard, we have found that, in comparing our process with the control process which omits post-exposure charging, both produce comparable dynamic exposure range when neg-pos development is practiced immediately. However, when neg-pos development is delayed well into the period of persistence, the dynamic exposure range of the control process becomes progressively worse, while that of our process remains high and thus greater than the control process.

The extent to which the photoreceptor is post-exposure-charged can vary. Generally, uniform overall charging of the photoreceptor is carried out until fully exposed regions attain a measured surface potential equal to or less than Vo, preferably from about ⅓ Vo to Vo. In selecting an appropriate recharging level, such factors as the desired contrast of the image, amount of dynamic exposure range desired, and lapse of time between development and recharging are considered. On-line evaluations can be conducted using a stepped density gray scale original for comparison.

After post-charging, the modified charge image can be developed immediately, or after a period of time, to produce a visible image which reflects the improved sensitometric response of the charge image. Alternatively, the charge image can be electrically read and/or displayed in order to derive the information it represents.

The latent image is developed to a visible image by any of a variety of means such as a liquid electrographic developer. Suitable liquid developers include those described in U.S. Pat. No. 4,202,785 issued May 13, 1980, to D. Santilli et al. Alternatively, dry electrographic developers can be employed.

The process of forming latent electrostatic images of the present invention can be practiced on single-use or reusable, persistently conductive photoreceptors. When employing a reusable material, the latent image can either be developed on the photoreceptor and the developed image transferred to a receiver, or the latent image can be transferred to a receiver prior to development.

The following examples are provided to aid in the practice of the invention.

EXAMPLE 1

This example ilustrates the method of the present invention in which a persistently conductive photoreceptor is post-exposure-recharged within its period of persistence and thereafter developed in a pos-pos mode. Comparison is made with an otherwise identical process in which the recharging step was omitted.

A persistently conductive photoreceptor as described in the examples of U.S. Pat. No. 4,301,226 was employed. The element exhibited a period of persistence of approximately 0.5 hour.

The elements employed were charged to −600 volts under a negative corona discharge from a multi-wire grid-controlled corona charger and exposed for 2 sec through a 0.3 log E stepped-density gray scale to a mercury vapor lamp. Immediately after exposure and prior to the development step, one of the elements was recharged for 2 sec with the corona charger set point at −400 volts. The recharged element was then developed pos-pos with a liquid electrographic developer as described in Example 1 of copending U.S. patent application Ser. No. 249,330 filed Mar. 31, 1981, in the names of P. S. Alexandrovich et al.

The second element was subjected to the same procedure, omitting the post-exposure charging step.

For each element, the optical density of the developed image was recorded and plotted versus the log exposure. The dynamic exposure range for each element was determined as the distance between the shoulder and toe exposures in the plot.

The dynamic exposure range for the recharged element was 2.60, while that of the second element was 2.25.

EXAMPLE 2

This demonstrates the method of the present invention wherein the recharged electrostatic image is developed in a neg-pos mode by electrically biasing the developer to cause development in photodischarged regions of the image. Comparison is again made with a nonrecharged element as in Example 1.

The procedure of Example 1 was repeated except that positive polarity charging was employed and the developer was electrically biased to +525 volts.

Approximately 15 sec after exposure, the recharged element was developed for a period of time sufficient to give an optical density of 2.0. The unrecharged element was also developed 15 sec after exposure to give the same optical density. The recharged element required development times of 0.5 and 1 sec for two contrast levels, respectively. For the same contrast levels and 2.0 optical density, the unrecharged element required development times of 1 and 2 sec, respectively.

When development took place 30 min after exposure and recharging for our process, and 30 min after exposure for the control process, the dynamic exposure range for the recharged element was 2.0, while that of the unrecharged element was 1.6.

EXAMPLE 3

This illustrates imaging of a photoreceptor which was not persistently conductive with and without a postexposure charging step.

Example 2 was repeated except that the element was a photoreceptor exhibiting substantially no persistent conductivity. Development took place within the 15-sec time period after exposure.

The dynamic exposure range for the recharged, nonpersistently conductive photoreceptor was the same as the dynamic exposure range for the photoreceptor which was not recharged.

EXAMPLE 4

This illustrates postexposure charging of a persistently conductive photoreceptor after its period of persistence.

Example 2 was repeated except that recharging of the photoreceptor took place after 30 min from exposure. The photoreceptor had a period of persistence of about 30 min.

The dynamic exposure range of the recharged photoreceptor was approximately the same as the dynamic exposure range for the nonrecharged photoreceptor.

Although the invention has been described in considerable detail with particular reference to certain preferred embodiments thereof, variations and modifications can be effected within the spirit and scope of the invention.

What is claimed is:

1. A method for improving the sensitometric response of a zinc oxide-free persistently conductive photoreceptor having a period of persistence comprising the steps of:

(a) uniformly charging said photoreceptor to a surface potential, Vo, of a given polarity, (b) imagewise-exposing said charged photoreceptor to actinic radiation to form a latent electrostatic image thereon and, (c) during its period of persistence, and prior to development, recharging said photoreceptor to a second surface potential of the same polarity as Vo, thereby producing a developable, modified latent electrostatic image.

2. The method of claim 1 wherein said period of persistence is at least 0.5 hour.

3. The method of claim 2 wherein said second surface potential is about ⅓ Vo to about Vo.

4. The method of claims 1, 2 or 3 wherein said modified latent electrostatic image is developed to a visible image with an electrographic developer compositions.

5. The method of claim 4 wherein charged regions of said modified electrostatic image are developed.

6. The method of claim 4 wherein uncharged regions of said modified electrostatic image are developed by electrically biasing said developer composition.

7. The method of claim 6 wherein said modified electrostatic image is developed at such time during the period of persistence and after recharging as to produce a visible image exhibiting an extended dynamic exposure range relative to an otherwise identical process in which said recharging is omitted.

8. A method for improving the sensitometric response of a persistently conductive photoreceptor comprising an arylalkane photoconductor in combination with a pyrylium sensitizing compound, said method comprising:

(a) uniformly charging said photoreceptor to a surface potential, Vo, of a given polarity, (b) imagewise-exposing said charged photoreceptor to actinic radiation to form a latent electrostatic image thereon, (c) during its period of persistence, and prior to develoment, recharging said photoreceptor to a second surface potential of the same polarity as Vo, and (d) developing said modified latent electrostatic image after step (c) into a visible image with an electrographic developer composition.

9. The method of claim 8 wherein said second surface potential is in the range from about ⅓ Vo to about Vo.

10. The method of claim 9 wherein charged regions of said modified electrostatic image are developed.

11. The method of claim 9 wherein uncharged regions of said modified electrostatic image are developed by electrically biasing said developer composition.

12. The method of claim 11 wherein said modified electrostatic image is developed at such time during the period of persistence and after recharging as to produce a visible image exhibiting an extended dynamic exposure range relative to an otherwise identical process in which said recharging is omitted.

* * * * *